US011067916B2

(12) United States Patent
Suzuki et al.

(10) Patent No.: US 11,067,916 B2
(45) Date of Patent: Jul. 20, 2021

(54) DRIVING APPARATUS AND PRINTING APPARATUS

(71) Applicant: CANON KABUSHIKI KAISHA, Tokyo (JP)

(72) Inventors: Takanori Suzuki, Tokyo (JP); Masanobu Ohmura, Yokohama (JP); Tatsuya Ryoki, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/001,915

(22) Filed: Aug. 25, 2020

(65) Prior Publication Data

US 2021/0063908 A1 Mar. 4, 2021

(30) Foreign Application Priority Data

Sep. 2, 2019 (JP) ..... JP2019-159727

(51) Int. Cl.
*G03G 15/043* (2006.01)
*G05F 1/56* (2006.01)
*G03G 15/04* (2006.01)

(52) U.S. Cl.
CPC ..... *G03G 15/043* (2013.01); *G03G 15/04054* (2013.01); *G05F 1/56* (2013.01)

(58) Field of Classification Search
CPC .. G03G 15/043; G03G 15/04054; G05F 1/56; B41J 2/45; B41J 2/451; B41J 2002/453
See application file for complete search history.

(56) References Cited

U.S. PATENT DOCUMENTS

| | | | | |
|---|---|---|---|---|
| 9,362,896 | B2 | 6/2016 | Suzuki et al. | B41J 29/00 |
| 9,774,769 | B2 | 9/2017 | Suzuki et al. | H05K 1/111 |
| 9,978,675 | B2 | 5/2018 | Suzuki et al. | H01L 23/50 |
| 2010/0289933 | A1* | 11/2010 | Ryoki | H04N 5/378 348/300 |
| 2013/0278586 | A1* | 10/2013 | Kawano | G09G 5/001 345/212 |
| 2014/0042928 | A1* | 2/2014 | Shikina | H05B 33/08 315/291 |

(Continued)

FOREIGN PATENT DOCUMENTS

JP 2008-58398 3/2008

OTHER PUBLICATIONS

U.S. Appl. No. 17/010,476, filed Sep. 2, 2020.

*Primary Examiner* — Carla J Therrien
(74) *Attorney, Agent, or Firm* — Venable LLP

(57) ABSTRACT

A driving apparatus comprising a driving circuit is provided. The driving circuit includes an output terminal to which the load element is connected, a current output circuit configured to supply a current to the load element, a voltage supply circuit configured to apply a voltage to the load element, a first signal line configured to control a timing at which the current output circuit starts supplying a current to the load element and a second signal line configured to control a timing at which the voltage supply circuit is turned off. The voltage supply circuit starts applying a voltage before the current output circuit supplies a current to the load element, and a timing at which the current output circuit starts supplying a current differs from a timing at which the voltage supply circuit turns off application of a voltage.

22 Claims, 10 Drawing Sheets

(56) References Cited

U.S. PATENT DOCUMENTS

| | | | | |
|---|---|---|---|---|
| 2015/0016152 | A1* | 1/2015 | Kojima | H02M 3/33569 363/21.02 |
| 2015/0279770 | A1 | 10/2015 | Kataoka et al. | 361/783 |
| 2021/0072661 | A1* | 3/2021 | Suzuki | G03G 15/043 |

* cited by examiner

DRIVING APPARATUS AND PRINTING APPARATUS

BACKGROUND OF THE INVENTION

Field of the Invention

The present invention relates to a driving apparatus and a printing apparatus.

Description of the Related Art

Japanese Patent Laid-Open No. 2008-58398 discloses a driving apparatus for an organic EL element. The driving apparatus disclosed in Japanese Patent Laid-Open No. 2008-58398 performs pre-charge driving to apply a predetermined voltage (pre-charge voltage) to a terminal for driving an organic EL element before constant-current driving so as to prevent insufficient light emission caused by a parasitic capacitance in the initial period of light emission by an organic EL element.

SUMMARY OF THE INVENTION

The driving apparatus disclosed in Japanese Patent Laid-Open No. 2008-58398 is provided with a switch between a constant current circuit for performing constant-current driving and a data electrode connected to an organic EL element to control the switching state of the switch so as to apply a pre-charge voltage during a pre-charge voltage supply period. The switching noise caused when the switch is switched to shift from pre-charge driving to constant-current driving is sometimes superimposed on a signal for controlling the organic EL element. When switching noise at the end of pre-charge driving overlaps switching noise at the start of constant-current driving, large noise is produced. This can degrade controllability pertaining to controlling of a load element by the driving apparatus, resulting in, for example, light emission variations of an organic EL element.

Some embodiments of the present invention provide techniques advantageous in improving controllability pertaining to controlling of load elements.

According to some embodiments, a driving apparatus for driving a load element, the apparatus comprising a driving circuit including: an output terminal to which the load element is connected; a current output circuit configured to supply a current to the load element via the output terminal; a voltage supply circuit configured to apply a voltage to the load element via the output terminal; a first signal line configured to control a timing at which the current output circuit starts supplying a current to the load element; and a second signal line configured to control a timing at which the voltage supply circuit is turned off, wherein the voltage supply circuit starts applying a voltage before the current output circuit supplies a current to the load element, and a timing at which the current output circuit starts supplying a current differs from a timing at which the voltage supply circuit turns off application of a voltage, is provided.

Further features of the present invention will become apparent from the following description of exemplary embodiments (with reference to the attached drawings).

DESCRIPTION OF THE EMBODIMENTS

Figure 1:
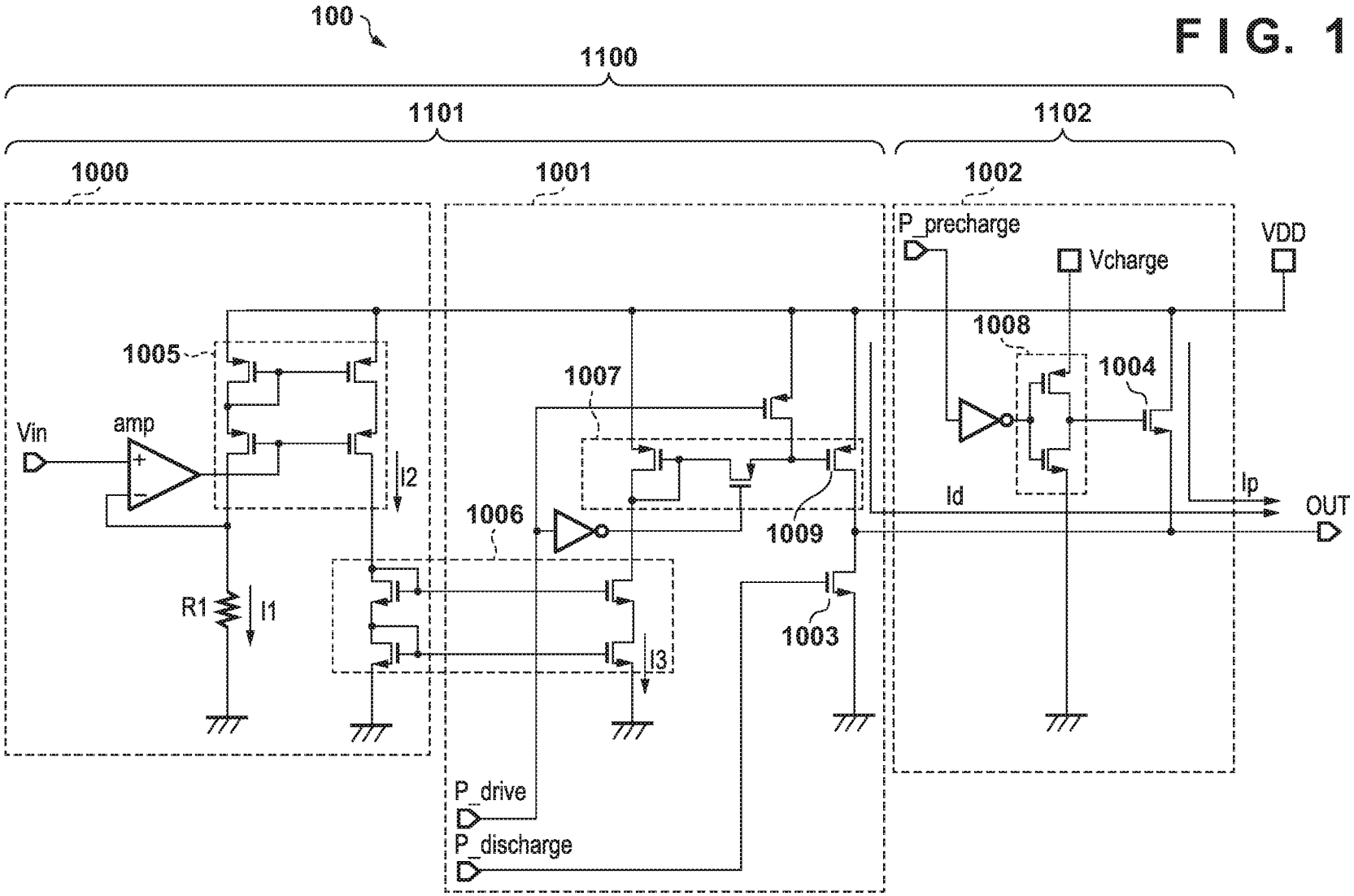
FIG. 1 is a circuit diagram showing an example of the arrangement of a driving apparatus according to an embodiment.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate. Furthermore, in the attached drawings, the same reference numerals are given to the same or similar configurations, and redundant description thereof is omitted.

Described below is a case in which the driving apparatus according to this embodiment drives a light-emitting element as a load element serving as an exposure head. The embodiment also exemplifies a light-emitting thyristor as a light-emitting element. However, the driving apparatus according to the embodiment can be applied to not only light emission control of a light-emitting element but also current control of current-driven elements in general. In addition, the driving apparatus according to the embodiment can also be applied to driving control of elements driven by a combination of a current and a voltage. Among current-driven elements, light-emitting elements are often used for printing apparatuses such as image forming apparatuses, and hence can require high-accuracy control. Among light-emitting elements, a light-emitting thyristor can require a large driving load for light emission control of a self-scanning type light-emitting element array described in the following embodiment.

Accordingly, it is highly necessary to improve the drive capacity of the driving apparatus and apply a pre-charge voltage to the driving apparatus before current driving. Under the circumstances, described below is the driving apparatus according to the embodiment which can effectively suppress switching noise and accurately control light emission.

The structure and operation of a driving apparatus according to a first embodiment will be described with reference to FIGS. 1 to 9. FIG. 1 is a circuit diagram showing an example of the arrangement of a driving circuit 1100 of a driving apparatus 100 according to this embodiment. The driving circuit 1100 includes a current output circuit 1101 that supplies a current to a load element and a voltage supply circuit 1102 for applying a voltage to the load element. The driving circuit 1100 includes an output terminal OUT to which a load element such as a light-emitting element is connected. The current output circuit 1101 and the voltage supply circuit 1102 supply a current and a voltage to the load element via the output terminal OUT. The current output circuit 1101 includes a current generating unit 1000 and a current control unit 1001 according to the embodiment. The voltage supply circuit 1102 includes a pre-charge control unit 1002.

Figure 2A:
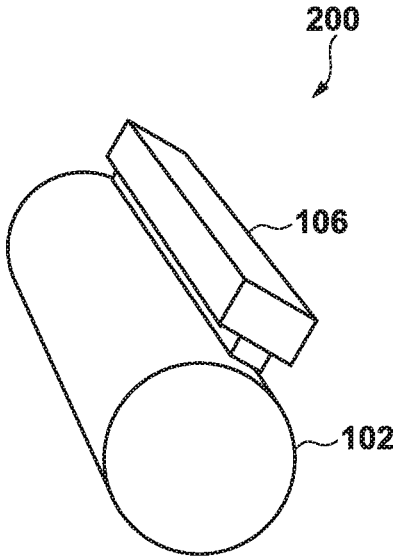
FIGS. 2A and 2B are views each showing an example of the arrangement of a printing apparatus including the driving apparatus in FIG. 1.
Figure 2B:
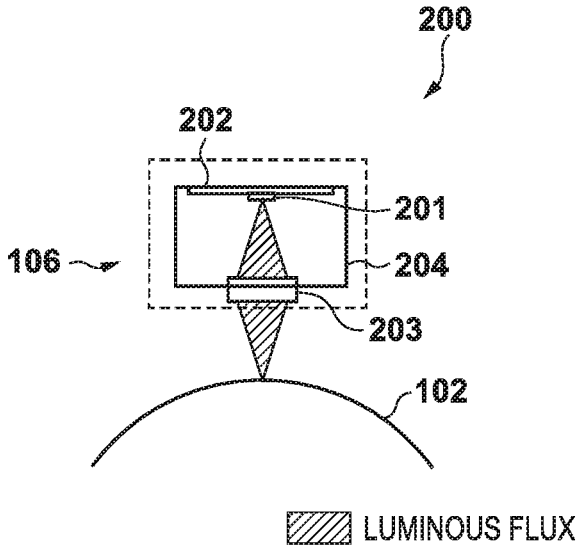

The operation of each component of the driving circuit 1100 of the driving apparatus 100 according to the present invention will be described later. Described first is a printing apparatus equipped with an element driven by the driving apparatus 100 of the driving circuit 1100 according to this embodiment. FIGS. 2A and 2B show a printing apparatus 200 including an exposure head 106 including the driving apparatus 100, a light-emitting element mounted on the exposure head 106 as a load element, and a photosensitive drum 102 that receives light from the light-emitting element. The exposure head 106 is equipped with a light-emitting unit 201 having a plurality of light-emitting element arrays with a plurality of light-emitting elements arranged in arrays. FIG. 2A shows an example of the placement of the exposure head 106 with respect to the photosensitive drum 102. FIG. 2B shows how light emitted from the light-emitting unit 201 is focused on the photosensitive drum 102. The exposure head 106 and the photosensitive drum 102 each are attached to the printing apparatus 200 with an attachment member (not shown). The exposure head 106 includes the light-emitting unit 201 provided with light-emitting elements subjected to driving control by the driving apparatus 100, a printed board 202 on which the light-emitting unit 201 is mounted, a rod lens array 203, and a housing 204 to which the rod lens array 203 and the printed board 202 are attached. FIGS. 2A and 2B do not show the driving apparatus 100 for the sake of descriptive simplicity. For example, the exposure head 106 can be singly assembled and adjusted in a manufacturing factory so as to perform focus adjustment and light amount adjustment for light emitted from each light-emitting element of the light-emitting unit 201. In this case, the photosensitive drum 102, the rod lens array 203, and the light-emitting unit 201 are arranged such that, for example, the distance between the photosensitive drum 102 and the rod lens array 203 and the distance between the rod lens array 203 and the light-emitting unit 201 are set to predetermined intervals. This focuses light emitted from the light-emitting unit 201 into an image on the photosensitive drum 102. For example, at the time of focus adjustment, the mounting position of the rod lens array 203 is adjusted such that the distance between the rod lens array 203 and the light-emitting unit 201 becomes a desired value. At the time of light amount adjustment, driving currents to the light-emitting elements driven by the driving apparatus 100 are adjusted such that the amount of light sequentially emitted from the respective light-emitting elements of the light-emitting unit 201 and focused through the rod lens array 203 is set to a predetermined amount of light.

Figure 3A:
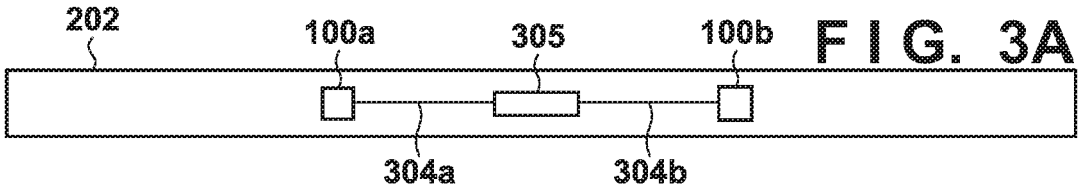
FIGS. 3A to 3C are views each showing an example of the arrangement of a substrate including the driving apparatus in FIG. 1.
Figure 3B:
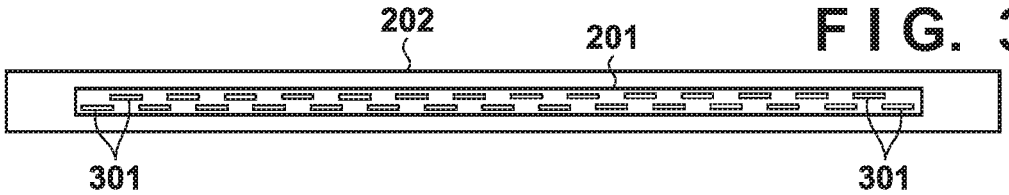
Figure 3C:
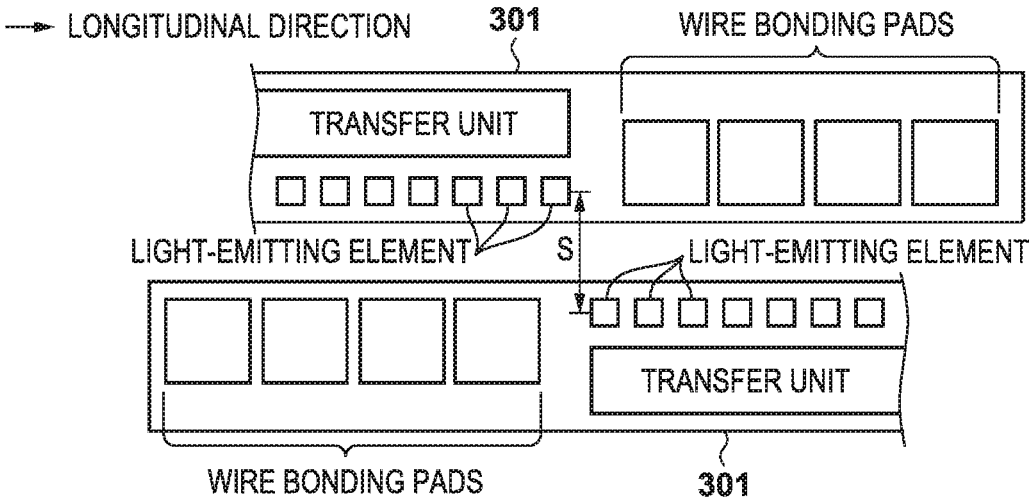

FIGS. 3A to 3C each show the printed board 202 on which the light-emitting unit 201 and the like are arranged. FIG. 3A shows that surface (to be sometimes referred to as the non-mounting surface) of the printed board 202 which is opposite to the surface on which the light-emitting unit 201 is mounted. FIG. 3B shows that surface (to be sometimes referred to as the mounting surface hereinafter) of the printed board 202 on which the light-emitting unit 201 is mounted. In this embodiment, the light-emitting unit 201 includes 29 light-emitting element arrays 301 arranged in a staggered pattern. Each light-emitting element array 301 includes 516 light-emitting elements arranged at a predetermined resolution pitch in the longitudinal direction of the light-emitting element array 301. The light-emitting element array 301 performs surface emitting. In this embodiment, the pitch of light-emitting elements is set to a pitch (about 21.16 μm) that implements a resolution of 1,200 dpi, and the interval from one end to the other end of the 516 light-emitting element in each light-emitting element array 301 is about 10.9 mm. When the 29 light-emitting element arrays 301 of the light-emitting unit 201 are arranged, the number of light-emitting elements capable of exposing operations is 14,964, and the light-emitting unit 201 can form an image corresponding to an image width of about 316 mm. The light-emitting element arrays 301 are arranged in two rows in a staggered pattern, and each row is arranged along the longitudinal direction of the printed board 202.

FIG. 3C shows the boundary portion between two light-emitting element arrays 301 of the 29 light-emitting element arrays 301 arranged in the light-emitting unit 201 on the printed board 202. Wire bonding pads for inputting control signals from the driving apparatus 100 are arranged in an end portion of each light-emitting element array 301. A transfer unit and light-emitting elements are driven by the signals input from the wire bonding pads. The pitch of the light-emitting elements in the longitudinal direction is a pitch (about 21.16 μm) corresponding to a resolution of 1,200 dpi even in the boundary portion between the light-emitting element arrays 301. In addition, in this embodiment, the light-emitting elements of the light-emitting element arrays 301 arranged in a staggered pattern are arranged such that the interval of the light-emitting elements (indicated by S in FIG. 3C) in the lateral direction becomes about 84 μm (corresponding to four pixels at 1,200 dpi and eight pixels at 2,400 dpi).

The driving apparatus 100 for driving the light-emitting elements of the light-emitting element arrays 301 is arranged on the non-mounting surface shown in FIG. 3A. In this embodiment, the driving apparatus 100 includes a driving apparatus 100*a* that drives the 15 light-emitting element arrays of the light-emitting element arrays 301 which are shown in FIG. 3B on the left side and a driving apparatus 100*b* that drives the 14 light-emitting element arrays on the right side. The driving apparatus 100*a* and the driving apparatus 100*b* are arranged on both sides of a connector 305. Signal lines that transmit image signals, power wires, ground lines, and the like, which are used to control the driving apparatuses 100*a* and 100*b* from an image controller (not shown), are connected to the connector 305. Signals and power from the image controller are supplied from the connector 305 to the driving apparatuses 100*a* and 100*b* via wiring patterns 304*a* and 304*b*. The wiring patterns via which the driving apparatuses 100*a* and 100*b* transmit signals for driving the respective light-emitting elements of the light-emitting element arrays 301 respectively extend to the corresponding light-emitting element arrays 301 via the surface layer and the inner layer of the printed board 202. Although FIG. 3A shows the arrangement in which the two driving apparatuses 100 are arranged, one or three or more driving apparatuses 100 may be arranged. It is possible to arrange a proper number of driving apparatuses 100 in accordance with the drive capacity of each driving apparatus 100, the number of light-emitting elements or light-emitting element arrays 301 arranged, and the like.

Figure 4:
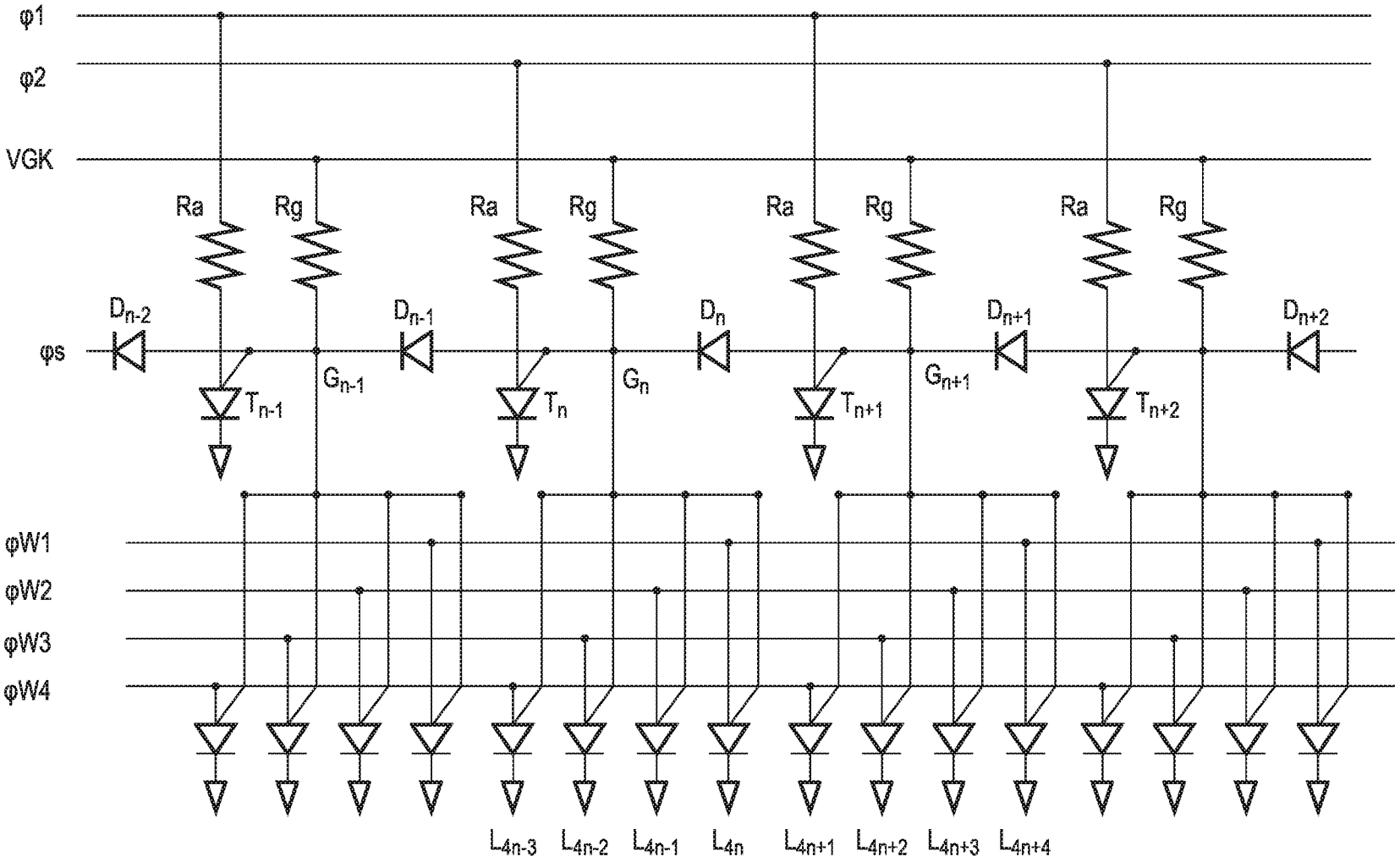
FIG. 4 is a circuit diagram showing an example of the arrangement of an element driven by the driving apparatus in FIG. 1.

A self-scanning type light-emitting element array including light-emitting thyristor elements will be described next as an example of the light-emitting element array 301 described above. FIG. 4 is an equivalent circuit showing part of a self-scanning type light-emitting element array driven by the driving apparatus 100 according to this embodiment. This array includes anode resistors Ra, gate resistors Rg, shift thyristors T, coupling diodes D, and light-emitting thyristors L. The array also includes common gates G of the shift thyristors T and the light-emitting thyristors L connected to the shift thyristors T. In this case, a shift thyristor $T_n$ indicates a specific shift thyristor of the shift thyristors T. In this case, n represents an integer equal to two or more. The same applies to the remaining constituent elements.

This array includes a transfer line Φ1 of each odd-numbered shift thyristor T, a transfer line Φ2 of each even-numbered shift thyristor T, turn-on signal lines ΦW1 to ΦW4 for the light-emitting thyristors L, a gate line VGK, and a start pulse line Φs. In the arrangement shown in FIG. 4, four light-emitting thyristors $L_n$ from $L_{4n-3}$ to $L_{4n}$ are connected to one shift thyristor $T_n$. This arrangement can simultaneously turn on the four light-emitting thyristors.

Figure 5A:
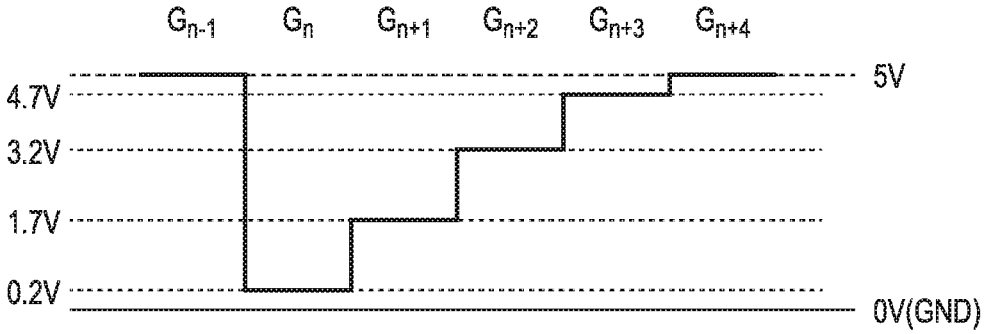
FIGS. 5A to 5C are charts each showing an example of the driven state of the element in FIG. 4.

The operation of the light-emitting element array shown in FIG. 4 will be described below. Assume that 5 V is applied to the gate line VGK, and the same voltage, that is, 5 V, is supplied to the transfer lines Φ1 and Φ2. Assume also that although the turn-on signal lines ΦW1 to ΦW4 correspond to inputs given by the driving apparatus 100 according to this embodiment, the voltage supplied to the turn-on signal lines ΦW1 to ΦW4 is the same as that applied to the transfer lines Φ1 and Φ2, that is, 5 V, only in the description made with reference to FIGS. 4 to 6 for the sake of simplifying the description of an operation. When the shift thyristor $T_n$ is in the ON state, the potential of a common gate $G_n$ of the shift thyristor $T_n$ and the light-emitting thyristor $L_n$ connected to the shift thyristor $T_n$ is lowered to about 0.2 V. Because the common gate $G_n$ is connected to a common gate $G_{n+1}$ via a coupling diode $D_n$, a potential difference almost equal to the built-in potential of the coupling diode $D_n$ is generated. In this embodiment, because the built-in potential of a coupling diode D is about 1.5 V, the potential of the common gate $G_{n+1}$ becomes 1.7 V, which is the sum of the potential of 0.2 V of the common gate $G_n$ and the built-in potential of 1.5 V. Likewise, the potential of a common gate $G_{n+2}$ becomes 3.2 V, and the potential of a common gate $G_{n+3}$ becomes 4.7 V. Note, however, that after a common gate $G_{n+4}$, the voltage of the gate line VGK is 5 V, which does not rise any more and remains 5 V. In addition, with regard to a portion before the common gate $G_n$ (the left side of FIG. 4), because the coupling diode is inversely biased, the voltage of the gate line VGK is applied to the portion without any change, that is, 5 V is applied. FIG. 5A shows the distribution of gate potentials when the shift thyristor $T_n$ is in the ON state. The voltage (to be sometimes referred to as a threshold voltage hereinafter) required to turn on each shift thyristor T is almost equal to the sum of each gate potential and the built-in potential. When the shift thyristor $T_n$ is ON, a shift thyristor $T_{n+2}$ has the lowest gate potential among the shift thyristors T connected to the same transfer line Φ2. For this reason, the potential of the common gate $G_{n+2}$ of the shift thyristor $T_{n+2}$ is 3.2 V as described above. Therefore, the threshold voltage of the shift thyristor $T_{n+2}$ is 4.7 V. However, because the shift thyristor $T_n$ is ON, the potential of the transfer line Φ2 is pulled to about 1.5 V (built-in potential), which is lower than the threshold voltage of the shift thyristor $T_{n+2}$. This makes it impossible for the shift thyristor $T_{n+2}$ to be turned on. Because all the remaining shift thyristors T connected to the same transfer line Φ2 have higher threshold voltages than the shift thyristor $T_{+2}$. This makes it impossible to turn on these shift thyristors in the same manner, and hence only the shift thyristor $T_n$ can be kept in the ON state.

Figure 5B:
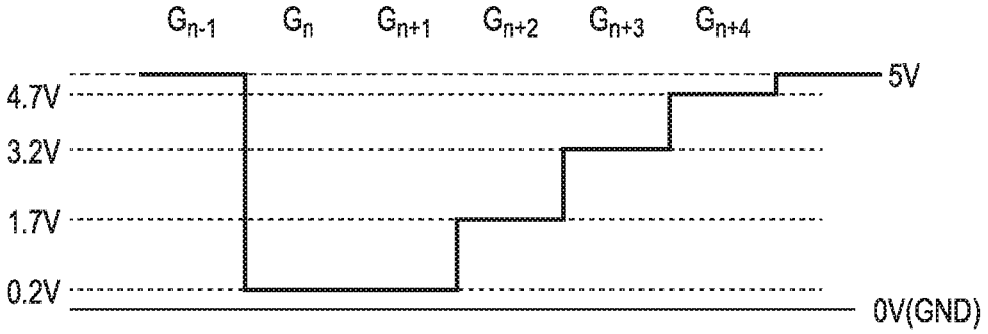
Figure 5C:
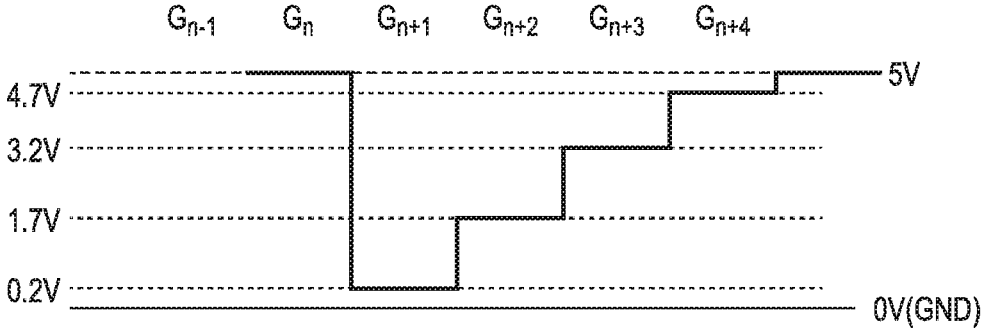

In addition, among the shift thyristors T connected to the transfer line Φ1, a shift thyristor $T_{n+1}$ has the lowest threshold voltage, which is 3.2 V, and a shift thyristor $T_{n+3}$ has the second lowest threshold voltage, which is 6.2 V. In this state, when 5 V is supplied to the transfer line Φ1, only the shift thyristor $T_{n+1}$ can make transition to the ON state. In this state, the shift thyristor $T_n$ and the shift thyristor $T_{n+1}$ are simultaneously ON, and the gate potential of each shift thyristor T on the right side of the shift thyristor $T_{n+1}$ is lowered by the built-in potential. Note, however, that because the gate line VGK is set at 5 V and the gate voltage is limited by the gate line VGK, each shift thyristor on the right side of a shift thyristor $T_{n+5}$ is set at 5 V. FIG. 5B shows a gate voltage distribution in this case. When the potential of the transfer line Φ1 is lowered to 0 V in this state, the shift thyristor $T_n$ is turned off, and the potential of the common gate $G_n$ rises to the potential of the gate line VGK. FIG. 5C shows a gate voltage distribution in this case. In this manner, the transfer of the ON state from the shift thyristor $T_n$ to the shift thyristor $T_{n+1}$ is completed.

The light-emitting operation of the light-emitting thyristor L will be described next. Consider a case in which only the shift thyristor $T_n$ is ON. The gate voltage of each of the four light-emitting thyristors $L_{4n-3}$ to $L_{4n}$ is 0.2 V, which is equal to the gate voltage of the common gate $G_n$ or the shift thyristor $T_n$, because the light-emitting thyristors are connected to the common gate $G_n$. Accordingly, the threshold of each of the light-emitting thyristors $L_{4n-3}$ to $L_{4n}$ is 1.7 V, and hence the light-emitting thyristors can be turned on when being supplied with voltages equal to or more than 1.7 V from the turn-on signal lines ΦW1 to ΦW4. That is, when the shift thyristor $T_n$ is ON, a proper combination of the four light-emitting thyristors $L_{4n-3}$ to $L_{4n}$ can be selectively made to emit light by supplying turn-on signals to the turn-on signal lines ΦW1 to ΦW4. In this case, the potential of the common gate $G_{n+1}$ of the shift thyristor $T_{n+1}$ arranged adjacent to the shift thyristor $T_n$ is 1.7 V, and the threshold voltage of each of the light-emitting thyristors $L_{4n+1}$ to $L_{4n+4}$ connected to the common gate $G_{n+1}$ becomes 3.2 V. Because each of turn-on signals supplied from the turn-on signal lines ΦW1 to ΦW4 is at 5 V, the light-emitting thyristors $L_{4n+1}$ to $L_{4n+4}$ may also be turned on in the same turn-on pattern as that of the light-emitting thyristors $L_{4n-3}$ to $L_{4n}$. However, because the threshold voltage of the light-emitting thyristors $L_{4n-3}$ to $L_{4n}$ is lower than that of the light-emitting thyristors $L_{4n+1}$ to $L_{4n+4}$, when turn-on signals are supplied, the light-emitting thyristors $L_{4n-3}$ to $L_{4n}$ are turned on earlier than the light-emitting thyristors $L_{4n+1}$ to $L_{4n+4}$. Once the light-emitting thyristors $L_{4n-3}$ to $L_{4n}$ are turned on, the potential of each of the connected turn-on signal lines ΦW1 to ΦW4 is pulled to about 1.5 V (built-in potential) to become lower than the threshold voltage of the light-emitting thyristors $L_{4n+1}$ to $L_{4n+4}$, and hence the light-emitting thyristors $L_{4n+1}$ to $L_{4n+4}$ cannot be turned on. Connecting a plurality of light-emitting thyristors L to one shift thyristor T in this manner can simultaneously turn on the plurality of light-emitting thyristors L.

Figure 6:
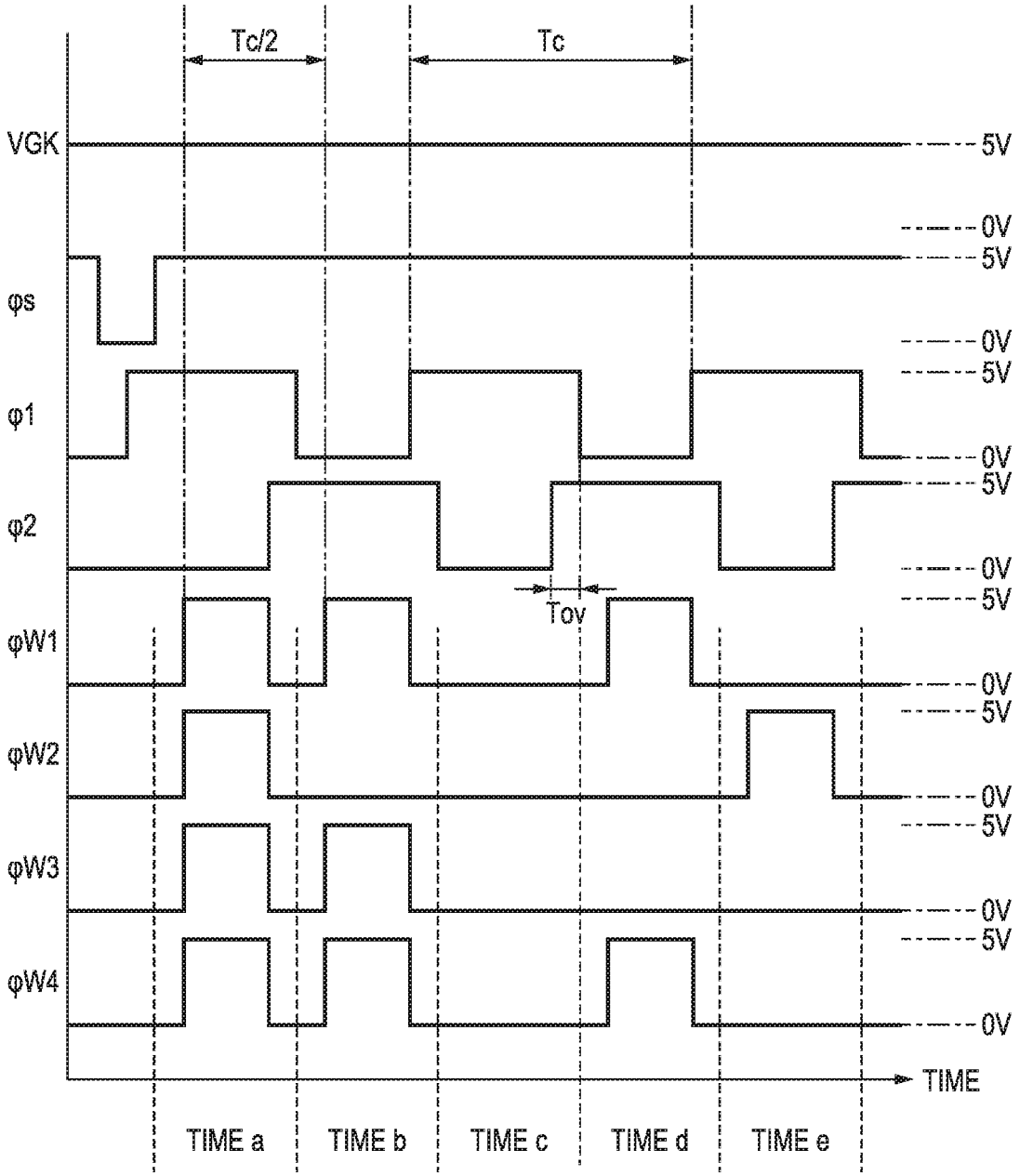
FIG. 6 is a timing chart showing an example of the driving timing of the element in FIG. 4.

FIG. 6 shows an example of driving signal waveforms for the light-emitting element array shown in FIG. 4. As described above, 5 V is always supplied to the gate line VGK. Clock signals are applied to the transfer line Φ1 for the odd-numbered shift thyristor T and the transfer line Φ2 for the even-numbered shift thyristor T in a same period Tc. Although 5 V is supplied to the start pulse line Φs, the voltage is lowered to 0 V to generate a potential difference from the gate line VGK slightly before the transfer line Φ1 is set at 5 V. With this operation, the voltage of a common gate G of the first shift thyristor T is pulled from 5 V to 1.5 V, and the threshold voltage becomes 3.0 V, thereby making the shift thyristor T as a light-emitting element be turned on by a signal through the transfer line Φ1. A voltage of 5 V is supplied to the start pulse line Φs slightly after 5 V is applied to the transfer line Φ1 and the first shift thyristor T makes transition to the ON state. Subsequently, 5 V is kept supplied to the start pulse line Φs. The transfer line Φ1 and the transfer line Φ2 are configured to have an almost complementary relationship, having time Tov during which the ON states (5 V in this case) overlap each other. The waveforms of the turn-on signal lines ΦW1 to ΦW4 of the light-emitting thyristors L are transmitted in a period half the period of the transfer lines Φ1 and Φ2. When 5 V is applied to the corresponding shift thyristor T in the ON state, the light-emitting thyristor L is turned on. For example, at time a, all the four light-emitting thyristors L connected to the same shift thyristor T are in the ON state. At time b, the three light-emitting thyristors L are simultaneously in the ON state. At time c, all the light-emitting thyristors L are in the OFF state. At time d, the two light-emitting thyristors L are simultaneously ON. At time e, only one light-emitting thyristor L is turned on. In this embodiment, the number of light-emitting thyristors L connected to the common gate G of one shift thyristor T is four. However, this is not exhaustive. The number of light-emitting thyristors L connected to the common gate G of one shift thyristor T may be three or less or five or more depending on the intended use.

The driving apparatus 100 according to this embodiment will be described by referring back to FIG. 1. The output terminal OUT of the driving circuit 1100 of the driving apparatus 100 is connected to one of the turn-on signal lines ΦW1 to ΦW4 of the light-emitting thyristors L of the light-emitting element array shown in FIG. 4. As shown in FIG. 4, in order to correspond to the four channels (Chs) of the turn-on signal lines ΦW1 to ΦW4, the driving apparatus 100 needs to have a plurality of driving circuits 1100, more specifically, four driving circuits 1100 (corresponding to four chs). More specifically, when output terminals OUT corresponding to the number of chs are required, the driving apparatus 100 may prepare driving circuits 1100, each having an arrangement similar to the above arrangement, in number corresponding to the required number of chs.

Referring to FIG. 1 showing the driving circuit 1100 corresponding to one ch, the current generating unit 1000 of the current output circuit 1101 generates current I1=Vin/R1 determined by a resistor R1 in accordance with an input voltage Vin. In this case, the input voltage Vin is supplied from, for example, the DAC included in the driving apparatus 100, and the voltage value is made variable to enable control of the current value I1 to a desired value. Alternatively, similar control can be implemented by fixing input voltage Vin and making the resistor R1 variable.

The current generating unit 1000 generates a current I2 from the current I1 via a current mirror circuit 1005. The current generating unit 1000 and the current control unit 1001 of the current output circuit 1101 constitute a current mirror circuit 1006. The current mirror circuit 1006 generates a current I3 from the current I2 and supplies the current I3 to the current control unit 1001. The current control unit 1001 further includes a current mirror circuit 1007, and generates, from the current I3, a current Id (which can also be called a driving current) that drives a load element (the light-emitting thyristor L as a light-emitting element in the case shown in FIG. 4). With the above arrangement, the current output circuit 1101 multiplies the current I1 generated by the current generating unit 1000 by a ratio corresponding to each of the mirror ratios of the current mirror circuits 1005 to 1007, and supplies the resultant current as the current Id from the current control unit 1001 to the load element via the output terminal OUT. The current control unit 1001 controls the start/end of supply of the current Id (ON/OFF of the current Id) with a signal P_drive. In a period in which the signal P_drive is Hi, the current Id is output from the current control unit 1001 of the current output circuit 1101 to the load element.

The driving apparatus 100 also includes a reset circuit for resetting the potential of the output terminal OUT. More specifically, a signal P_discharge controls a reset switch 1003 between the output terminal OUT and the ground terminal. In a period in which the signal P_discharge is Hi, when the reset switch 1003 is turned on (conductive) and the output terminal OUT is grounded, the light-emitting thyristor L as a load element is set in the reset state in which it stops emitting light.

The pre-charge control unit 1002 of the voltage supply circuit 1102 includes a switch 1004 arranged between the output terminal OUT and a power supply VDD and a control unit 1008 for controlling the switch 1004. A signal P_precharge performs ON/OFF (conductive/nonconductive) control of the switch 1004 via the control unit 1008. In a period in which the signal P_precharge is Lo, the gate potential of the switch 1004 is set at the ground level, and the switch 1004 is set in the OFF state, thereby turning off the application of a voltage from the voltage supply circuit 1102 to the load element. In a period in which the signal P_precharge is Hi, when the gate potential of the switch 1004 becomes a voltage Vcharge, the switch 1004 is turned on to enable (turn on) the application of a voltage from the voltage supply circuit 1102 to the load element.

As described above, the driving apparatus 100 separately includes a signal line for controlling the timing at which the current output circuit 1101 starts supplying the current Id to the load element (a signal line for supplying the signal P_drive) and a signal line for controlling the timing of turning off the voltage supply circuit 1102 (a signal line for supplying the signal P_precharge). As will be described later, this makes it possible to separately control the supply of the current Id to the load element by the current output circuit 1101 and the application of a pre-charge voltage by the voltage supply circuit 1102.

The function of the pre-charge control unit 1002 of the voltage supply circuit 1102 will be described below. In order to turn on the light-emitting thyristor L as a load element, the potential of the anode terminal of the light-emitting thyristor L needs to be raised to a predetermined light emission threshold voltage Voth or more. As show in FIG. 4, the anode terminals of the light-emitting thyristors L as a plurality of load elements are connected to a transfer line ΦW connected to the output terminal OUT. Accordingly, even if one light-emitting thyristor L is to be turned on, it is necessary to raise the potentials of the remaining anode terminals, that is, the potentials of the anode terminals of all the light-emitting thyristors L connected to the transfer line ΦW. Depending on the number of light-emitting thyristors L connected to the transfer line ΦW, the parasitic capacitance connected to the output terminal OUT sometimes becomes large. Assuming that the parasitic capacitance of the anode terminal of each light-emitting thyristor L is 1.0 pF, when the 200 light-emitting thyristors L are connected to the line, the parasitic capacitance becomes as large as 200 pF. That is, in order to start the light emission of the light-emitting thyristor L, it is necessary to charge the parasitic capacitance of 200 pF to the predetermined light emission threshold voltage.

When, however, the amount of light emitted by the light-emitting thyristor L is smaller, in other words, the required current Id is small, it takes a longer time to charge a parasitic capacitance, sometimes resulting in a failure to make the light-emitting thyristor L start emitting light within a predetermined time. Assume that the current Id for each light-emitting element mounted on the exposure head 106 of the printing apparatus shown in FIG. 2 is required to satisfy an output range specification of about 1 mA to about 10 mA. Assume also that specifications are required such that the integral amount of light emitted by the light-emitting element increases 10 times as the current Id increases from 1 mA to 10 mA. At this time, it is necessary to prevent variations in the period from the instant the supply of the current Id makes transition to the ON state by the signal P_drive regardless of the amount of current Id to the instant the light-emitting element exceeds the light emission threshold voltage Voth and starts emitting light. Accordingly, the time difference until the light-emitting thyristor L starts emitting light is shortened by charging the output terminal OUT to a voltage immediately before the light emission threshold voltage Voth of the light-emitting thyristor L. This is because, if the period from the start of the supply of the current Id to the start of light emission changes depending on the magnitude of the current Id, the integral amount of light emitted by the light-emitting element deviates from a predetermined integral amount of light depending on the magnitude of the current Id, resulting in influencing the image quality of the printing apparatus 200. In contrast to this, in this embodiment, the voltage supply circuit 1102 starts applying a pre-charge voltage to charge the node of the output terminal OUT before the current output circuit 1101 supplies the current Id to the light-emitting thyristor L as a load element. The timing at which the signal P_drive is set at Hi to cause the current output circuit 1101 to start supplying the current Id is sometimes called timing T1. The timing at which the signal P_precharge is set at Hi to cause the voltage supply circuit 1102 to turn off the application of a voltage before timing T1 and after the signal P_precharge is set at Hi to cause the voltage supply circuit 1102 to start applying a voltage is sometimes called timing T2.

Figure 7:
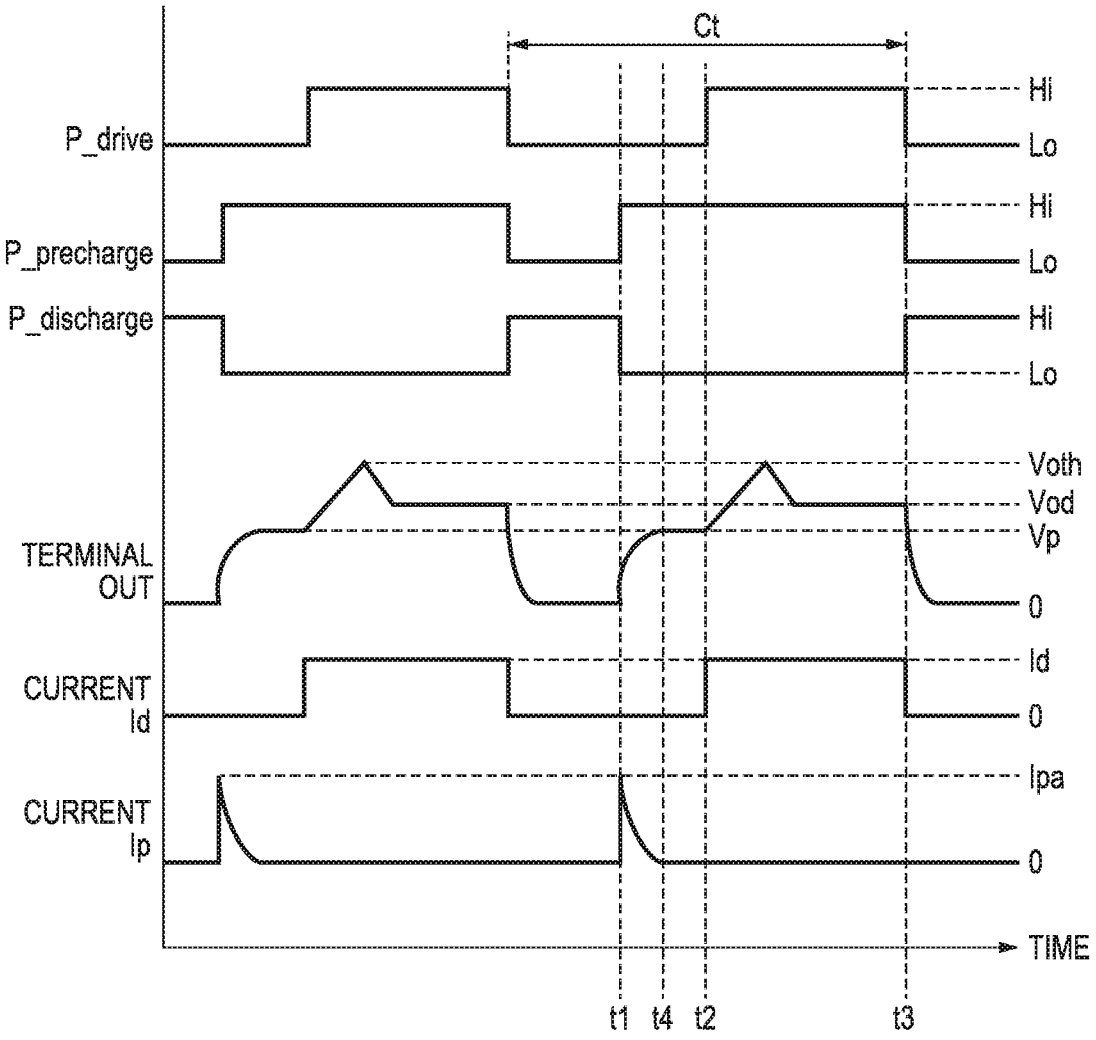
FIG. 7 is a timing chart showing an example of the driving timing of the driving apparatus in FIG. 1.

The operation timing of the driving circuit 1100 of the driving apparatus 100 according to this embodiment will be described next with reference to FIG. 7. Referring to FIG. 7, the three waveforms on the upper side respectively correspond to the inputs of the signal P_drive, the signal P_precharge, and the signal P_discharge in FIG. 1, each taking two states, namely, Hi and Lo. The three waveforms on the lower side exemplify response waveforms from the driving circuit 1100 with respect to the inputs of the signal P_drive, the signal P_precharge, and the signal P_discharge. The terminal OUT is the voltage waveform of the output terminal OUT to which the anode terminal of the light-emitting thyristor L as a load element is connected. The current Id is the waveform of the above current Id output from the current output circuit 1101. A current Ip represents the waveform of the current Ip supplied by the application of a voltage from the pre-charge control unit 1002 as the voltage supply circuit 1102. The sum current of the current Id and the current Ip is supplied from the output terminal OUT to the anode terminal of the light-emitting thyristor L. A period Ct shown in FIG. 7 indicates a one-cycle period for light emission control of the light-emitting thyristor L.

Light emission control of the driving apparatus 100 in one cycle indicated by the period Ct will be described next. At time t1, the signal P_discharge is set at Lo to cut off the output terminal OUT from the ground terminal, and the signal P_precharge is set at Hi to turn on the voltage supply circuit 1102 to apply a voltage to the anode terminal of the light-emitting thyristor L. A relatively large current Ipa as the current Ip flows immediately after the voltage supply circuit 1102 is turned on to start applying a voltage. Thereafter, as the voltage of the output terminal OUT rises, the current Ip decreases. When the voltage of the output terminal OUT rises to the value of a voltage Vp applied by the voltage supply circuit 1102, the current Ip from the voltage supply circuit 1102 becomes zero to stabilize the voltage of the output terminal OUT. In this embodiment, the voltage Vp applied from the pre-charge control unit 1002 of the voltage supply circuit 1102 is set to a value equal to or less than the light emission threshold voltage Voth of the light-emitting thyristor L. That is, as will be described in detail later, the voltage Vp is equal to or less than the driving threshold voltage of a load element driven by the driving apparatus 100. This can prevent the light-emitting thyristor L from starting emitting light by only the application of a pre-charge voltage by the voltage supply circuit 1102 before the signal P_drive is set at Hi.

The voltage of the output terminal OUT starts to rise when the application of a voltage by the voltage supply circuit 1102 starts (the switch 1004 is turned on) at time t1. Thereafter, the voltage of the output terminal OUT is stabilized at the voltage Vp applied by the pre-charge control unit 1002, and the current Ip from the voltage supply circuit 1102 becomes zero at time t4 between time t1 and time t2 at which the current output circuit 1101 starts supplying the current Id. Subsequently, at time t2, the signal P_drive is set at Hi to cause the current output circuit 1101 to start supplying the current Id. Time t2 corresponds to timing T1 described above at which the current output circuit 1101 starts supplying the current Id. In addition, at time t2, the voltage supply circuit 1102 does not turn off the application of a voltage (does not turn off the switch 1004). That is, timing T1 at which the current output circuit 1101 starts supplying the current Id differs from timing T2 described above at which the voltage supply circuit 1102 turns off the application of a voltage.

For example, the voltage supply circuit 1102 may turn off the application of a voltage after the lapse of a predetermined period since the start of supply of the current Id by the current output circuit 1101. This predetermined time is longer than the time during which the switch disclosed in Japanese Patent Laid-Open No. 2008-58398 switches between the terminal to which a constant current is supplied and the terminal to which a pre-charge voltage is applied. According to the operation shown in FIG. 7, the voltage supply circuit 1102 keeps the signal P_precharge at Hi even after the start of supply of the current Id by the current output circuit 1101. In such a case, setting timing T1 and timing T2 as different timings can prevent the occurrence of large switching noise upon superimposition of switching noise at the end of pre-charge driving on switching noise at the start of constant-current driving.

The occurrence of large switching noise can have the following influences on control of a load element. One of the influences is that switching noise is superimposed on the voltage of the output terminal OUT, which is stabilized at the voltage Vp applied by the voltage supply circuit 1102, to cause variation in the voltage Vp. When the voltage value of the output terminal OUT varies from the desired voltage Vp at the time of turning off the application of a voltage by the voltage supply circuit 1102, the light emission start timing of the light-emitting thyristor L may deviate to degrade the image quality of an image printed by the printing apparatus 200. Another influence is that the current Id supplied by the current output circuit 1101 can be destabilized due to the influence of switching noise. While a light-emitting element such as the light-emitting thyristor L emits light, a proper additional capacitance is sometimes provided for the current output circuit 1101 with importance being placed on stably obtaining a certain amount of light from the light-emitting thyristor L. For this reason, when a reference potential and a power supply constituting the current output circuit 1101 vary due to the influences of switching noise and the current output circuit 1101 becomes temporarily destabilized, it takes much time until the circuit is stabilized. The current Id output from the current control unit 1001 may deviate from a predetermined value and the amount of light emitted by the light-emitting element may deviate during a period until the current output circuit 1101 is stabilized. Accordingly, in this embodiment, setting timing T1 and timing T2 as different timings can suppress the influences of switching noise and implement high-accuracy control for the load element.

As shown in FIG. 4, consider a case in which a plurality of load elements are connected to one output terminal OUT of the driving circuit 1100 of the driving apparatus 100 to increase the driving load on the driving apparatus 100. This case results in increasing both the size of a switch (a transistor 1009) for supplying the current Id from the current output circuit 1101 at timing T1 and the size of a switch (the switch 1004) for switching off the voltage supply circuit 1102 at timing T2. This tends to increase the influences of switching noise. In addition, in the case shown in FIG. 4, although the driving apparatus 100 requires the driving circuits 1100 corresponding to four chs, when the driving apparatus 100 includes a plurality of output terminals OUT, switching noise is superimposed between the output terminals OUT, thus tending to increase the influences of the switching noise. In this embodiment, setting timing T1 and timing T2 as different timings make it possible to effectively suppress switching noise and implement high-accuracy load element control even in the driving apparatus 100 including a plurality of driving circuits 1100.

Subsequently, the period from time t2 to time t3 becomes a turn-on period of the light-emitting thyristor L. The light-emitting thyristor L is turned on to emit light in an amount corresponding to the current Id supplied by the current output circuit 1101. At time t3, when both the signal P_drive and the signal P_precharge are set at Lo and the signal P_discharge is set at Hi, the output terminal OUT is connected to the ground terminal and reset. When the output terminal OUT is connected to the ground terminal, the electric charge accumulated in the parasitic capacitance of the light-emitting thyristor L quickly flows to the ground terminal to lower the potential of the output terminal OUT. This makes it possible to quickly and reliably turn off the light-emitting thyristor L.

The operation of the voltage supply circuit 1102 according to this embodiment will be described next. As shown in FIG. 1, the voltage supply circuit 1102 includes a voltage supply transistor as the switch 1004 for controlling application of a voltage to the load element and ON/OFF of the application of the voltage. The embodiment exemplifies a case in which an NMOS transistor is used as the switch 1004. The pre-charge control unit 1002 of the voltage supply circuit 1102 can control a voltage to be applied (the voltage Vp described above) with the voltage Vcharge. As described above, in a period in which the signal P_precharge is set at Hi to turn on the switch 1004 (turn on the voltage supply circuit 1102), the potential of the gate terminal of the switch 1004 becomes equal to the voltage Vcharge, and the current Ip flows from the drain terminal of the switch 1004 to raise the potential of the output terminal OUT immediately after the switch 1004 is turned on. In this case, when the voltage supply circuit 1102 applies a voltage to the load element, the gate voltage of the switch 1004 as a voltage supply transistor may be configured to be controllable as in the arrangement shown in FIG. 1 in which the voltage Vcharge shown in FIG. 1 is applied to the gate terminal of the switch 1004. With this arrangement, even if the potential on the drain terminal side of the switch 1004 slightly varies, when the threshold voltage of the transistor of the switch 1004 is represented by Vt, the voltage Vp to be applied is stabilized as a voltage value determined by (Vcharge−Vt). However, the switch 1004 is not limited to a transistor. It is also possible to use a technique of using a general open/short switch as the switch 1004 such that when the signal P_precharge is set at Hi, the switch is short-circuited to directly apply the voltage value of the voltage Vcharge to the output terminal OUT.

In this case, the current output circuit 1101 includes a current output transistor as a switch for controlling ON/OFF of supply of the current Id to the load element. The current output transistor indicates the output transistor 1009 of the current mirror circuit 1007 of the current output circuit 1101. As shown in FIG. 1, this embodiment exemplifies a case in which a PMOS transistor is used as the transistor 1009 of the current control unit 1001. The transistor 1009 is a transistor that copies the reference current I3 as the drain current obtained by multiplying the reference current I3 by a ratio corresponding to the mirror ratio using the current mirror circuit 1007. This drain current serves as the current Id. In the embodiment, the transistor (voltage supply transistor) functioning as the switch 1004 differs in conductivity type from the transistor 1009 (current output transistor). In addition, in the embodiment, light emission control of the light-emitting thyristor L is performed on the anode side. When, however, this control is performed on the cathode side, an NMOS transistor may generate the current Id, and a PMOS transistor may control the application of the voltage Vp. The generation of the current Id and the application of the voltage Vp are performed by the transistors of different conductivity types. With this operation, for example, at the time of stopping light emission, even if the current output circuit 1101 and the voltage supply circuit 1102 simultaneously make transition to the OFF state, part of the electric charge charged on the output terminal sides of the respective transistor is canceled. This suppresses switching noise and facilitates providing stability as a system.

The design value of the voltage Vp applied from the voltage supply circuit 1102 to the load element will be described next. For example, as shown in FIG. 1, the drain terminal of the switch 1004 can be connected to the 5-V power supply VDD. In this case, assuming that the threshold voltage of the transistor of the switch 1004 is represented by Vt, the voltage Vp supplied from the voltage supply circuit 1102 is (Vcharge−Vt). Even in a period in which when the potential of the output terminal OUT rises to (Vcharge−Vt) after the signal P_precharge is set at Hi, the signal P_precharge is in the Hi state, the switch 1004 does not supply the current Ip to the output terminal OUT.

Light emission control sometimes can be performed with higher accuracy by making the voltage Vp equal to or less than the light emission threshold voltage of the light-emitting thyristor L. For example, the power supply VDD applies 5 V to the drain terminal of the switch 1004, and the voltage Vp is designed to be 1.0 V, assuming that the light emission threshold value Voth of the light-emitting thyristor L is 2 V, and the built-in potential of the light-emitting thyristor L is 1.5 V. When the threshold voltage Vt of the transistor of the switch 1004 is 0.5 V, setting the voltage Vcharge to 1.5 V can obtain voltage Vp=1.0 V. In this case, in the ON state of the light-emitting thyristor L, the potential of the output terminal OUT is 1.5 V, which is the built-in potential, and hence the supply of a current from the pre-charge control unit 1002 can be stopped without setting the signal P_precharge at Lo to turn off the voltage supply circuit 1102. That is, even after the current output circuit 1101 starts supplying the current Id, the voltage supply circuit 1102 need not turn off the gate of the switch 1004 until the timing at which light emission is stopped. With this operation, in a period in which the current output circuit 1101 supplies the current Id to control light emission, no switching noise occurs at timing T2 at which the voltage supply circuit 1102 is turned off, thereby enabling light emission control with higher accuracy.

For example, as shown in FIG. 7, the timing at which the current output circuit 1101 ends the supply of the current Id may coincide with the timing at which the voltage supply circuit 1102 turns off the application of a voltage (timing T2). Assume that slightly large switching noise is generated at the timing of stopping light emission, and the current output circuit 1101 is destabilized due to the influences of switching noise. Even in this case, light emission control is not much influenced under a situation in which light emission is stopped. In addition, as shown in FIG. 7, the timing at which the current output circuit 1101 ends the supply of the current Id may coincide with the timing at which the voltage supply circuit 1102 turns off the application of a voltage and the timing (signal P_discharge) at which the reset circuit starts resetting the potential of the output terminal OUT. This makes it possible to reliably stop light emission under a situation in which switching noise can occur.

The voltage supply circuit 1102 may apply a voltage, to the load element, from a voltage source higher than the light emission threshold voltage of the light-emitting thyristor L, which is a load element. In this embodiment, when the voltage Vp is applied to the load element, the power supply VDD higher than the light emission threshold voltage of the light-emitting thyristor L is supplied to the drain terminal of the switch 1004. This is because this prevents a current from flowing from the output terminal OUT side as the source terminal side of the switch 1004 to the power source side as the drain terminal side when the potential of the drain terminal side of the switch 1004 as the power source is always higher than that of the output terminal OUT. That is, applying a voltage, to the load element, from a voltage source higher than the light emission threshold voltage via the switch 1004 prevents a current from flowing from the output terminal OUT to the voltage supply circuit 1102. Therefore, using the arrangement shown in FIG. 1 can cause the voltage supply circuit 1102 to apply a voltage simultaneously with the supply of the current Id to the load element by the current output circuit 1101 without causing part of the current Id to flow to the voltage supply circuit 1102.

The above arrangement can control the gate voltage of the switch 1004 with the voltage Vcharge and control the voltage Vp applied by the voltage supply circuit 1102 as (Vcharge−Vt). In addition, the voltage supply circuit 1102 can charge the voltage of the output terminal OUT to a voltage value near the light emission threshold voltage before light emission by the light-emitting thyristor L, and hence can cause the light-emitting thyristor L to start emitting light within a predetermined time even if the amount of current Id is small.

In this case, as the voltage Vcharge that controls the gate voltage of the switch 1004, a proper potential may be directly supplied from the outside of the driving apparatus 100. However, this is not exhaustive. The driving apparatus 100 may include a control circuit for controlling the gate voltage of the switch 1004, which is a voltage supply transistor. In consideration of ease of use for a user who constructs a system by using the driving apparatus 100, it is preferable that the driving apparatus 100 can internally generate the voltage Vcharge as an output from the control circuit. In addition, when a plurality of load elements are connected to the output terminal OUT, the driving apparatus 100 may be configured to be able to change the voltage Vcharge for, for example, each period Ct as a cycle of light emission control for each load element or in units of a plurality of load elements. For example, such device can be implemented by making a voltage value output from a predetermined voltage source variable by using a control circuit such as a DAC and using an output from the control circuit as the voltage Vcharge. The driving threshold voltages of load elements can vary among them, and hence driving control with higher accuracy can be implemented by adjusting the voltage Vcharge in accordance with the driving threshold voltages. Alternatively, when the driving apparatus 100 includes a plurality of driving circuits 1100, the driving apparatus 100 may be provided with a plurality of control circuits. Driving control with higher accuracy can be implemented by making the voltage Vcharge variable, for each driving circuit 1100, in accordance with variations between the driving threshold voltage of each load element and the threshold voltage Vt of the transistor of the switch 1004.

Figure 8:
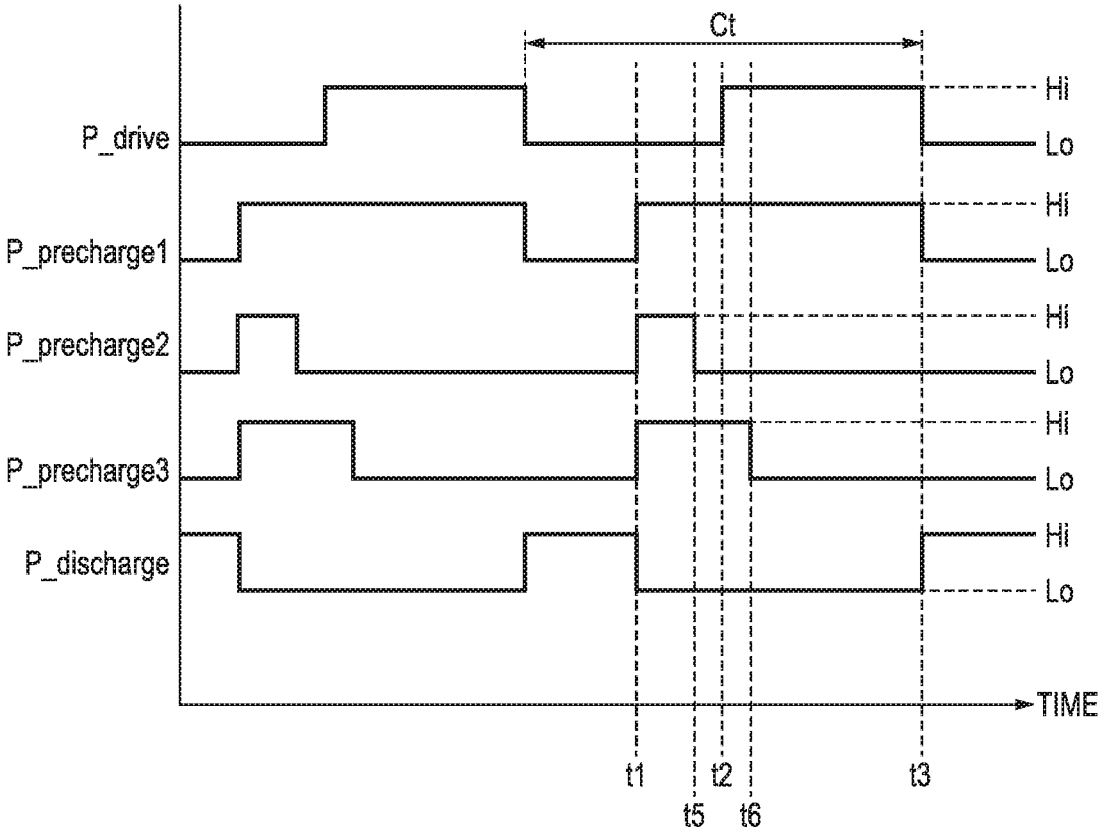
FIG. 8 is a timing chart showing an example of the driving timing of the driving apparatus in FIG. 1.

FIG. 8 is a timing chart for explaining a modification pertaining to timing T1 and timing T2 described above. Like FIG. 7, FIG. 8 corresponds to the inputs of the signal P_drive, the signal P_precharge, and the signal P_discharge in FIG. 1. When the signal P_drive is set in the Hi state, the current output circuit 1101 supplies the current Id to the load element. When the signal P_discharge is set in the Hi state, the reset switch 1003 of the reset circuit is set in the ON state to stop light emission. When the signal P_precharge is set in the Hi state, the voltage supply circuit 1102 applies the voltage Vp to the load element. In this case, FIG. 8 shows three examples, namely, signals P_precharge1 to P_precharge3, as modifications of the signal P_precharge.

The relationship between the signal P_drive, the signal P_discharge, and the signal P_precharge1 corresponds to the same timing as the driving timing shown in FIG. 7. At time t1, the signal P_precharge1 is set at Hi, and the signal P_discharge is set at Low. At time t2, the signal P_drive is set at Hi (timing T1). Subsequently, at time t3, the signal P_drive and the signal P_precharge1 are set at Low (timing T2), and the signal P_discharge is set at Hi. Setting timing T1 and timing T2 as different timings suppresses an increase in switching noise. This enables the driving method to implement high-accuracy driving control described above. In addition, the period between time t2 and time t3 is a period in which both the current output circuit 1101 and the voltage supply circuit 1102 are simultaneously enabled and driven. Timing T2 at which the application of a voltage by the voltage supply circuit 1102 is turned off may come after the lapse of a predetermined period since timing T1. Even if the operation at timing T2 is executed at a proper time between time t2 and time t3, setting timing T1 and timing T2 as different timings can obtain the effect according to this embodiment by suppressing an increase in switching noise. However, turning off the application of a voltage by the voltage supply circuit 1102 at time t3 at which light emission is stopped can prevent switching noise caused by turning off of the voltage supply circuit 1102 during light emission control from influencing the light emission control. This makes it possible to implement driving control with higher accuracy. Such driving provides a large effect when the voltage Vp applied by the voltage supply circuit 1102 is equal to or less than the light emission threshold voltage Voth of the light-emitting thyristor L and equal to or less than a built-in potential Vod.

The relationship between the signal P_drive, the signal P_discharge, and the signal P_precharge2 will be described next. At time t1, the signal P_precharge2 is set at Hi, and the signal P_discharge is set at Lo. At time t5, the signal P_precharge2 is set at Lo (timing T2). That is, the voltage supply circuit 1102 turns off the application of a voltage before the current output circuit 1101 starts supplying the current Id. At time t2 after the lapse of a predetermined period since timing T2 at which the signal P_precharge2 is set at Lo, the signal P_drive is set at Hi (timing T1). Thereafter, at time t3, the signal P_drive is set at Low, and the signal P_discharge is set at Hi. Setting timing T1 and timing T2 as different timings can also obtain the effect of suppressing an increase in switching noise in this operation. The period from time t5 to time t2 is a period in which both the current output circuit 1101 and the voltage supply circuit 1102 are disabled. At time t5, the output terminal OUT becomes floating while holding the voltage value applied by the voltage supply circuit. At time t5, the voltage supply circuit 1102 is turned off. However, generated switching noise is small because timing T1 differs from timing T2, and the voltage value of the output terminal OUT can be regarded as the voltage Vp applied from the voltage supply circuit 1102. Driving at such timings is effective in a case in which the period from time t5 to time t2 can be ensured.

The relationship between the signal P_drive, the signal P_discharge, and the signal P_precharge3 will be described next. At time t1, the signal P_precharge3 is set at Hi, and the signal P_discharge is set at Lo. At time t2, the signal P_drive is set at Hi (timing T1). Thereafter, at time t6, the signal P_precharge3 is set at Lo (timing T2). That is, after the current output circuit 1101 starts supplying the current Id and before the current output circuit 1101 ends applying the current Id, the voltage supply circuit 1102 turns off the application of a voltage. At time t3, the signal P_drive is set at Lo, and the signal P_discharge is set at Hi. In this operation as well, setting timing T1 and timing T2 as different timings can obtain effects similar to those in each operation described above. The period from time t2 to time t6 is a period in which both the current output circuit 1101 and the voltage supply circuit 1102 are enabled. Although the supply of the current Id is started from time t2, no problem occurs even if the current Ip is supplied by the application of a voltage from the voltage supply circuit 1102 in the period from time t2 to time t6. In addition, although described later, the operations indicated by the signals P_discharge1 and P_dischrge3 are effective especially when driving control is performed fast and precisely.

As described above, timing T1 and timing T2 can be separately controlled to perform various types of high-accuracy driving control in consideration of the target value of an integral light amount and the period Ct of a light emission cycle. The driving apparatus 100 may be configured to allow adjustment of the relationship between timings before and after timing T1 and timing T2 in addition to the relationship between timing T1 and timing T2. In addition, for example, the driving apparatus 100 may be configured to enable ON/OFF control of the switch 1004 under input control from outside the driving apparatus 100. This can obtain desired timing T2, and hence facilitates implementing high-accuracy driving control.

Figure 9:
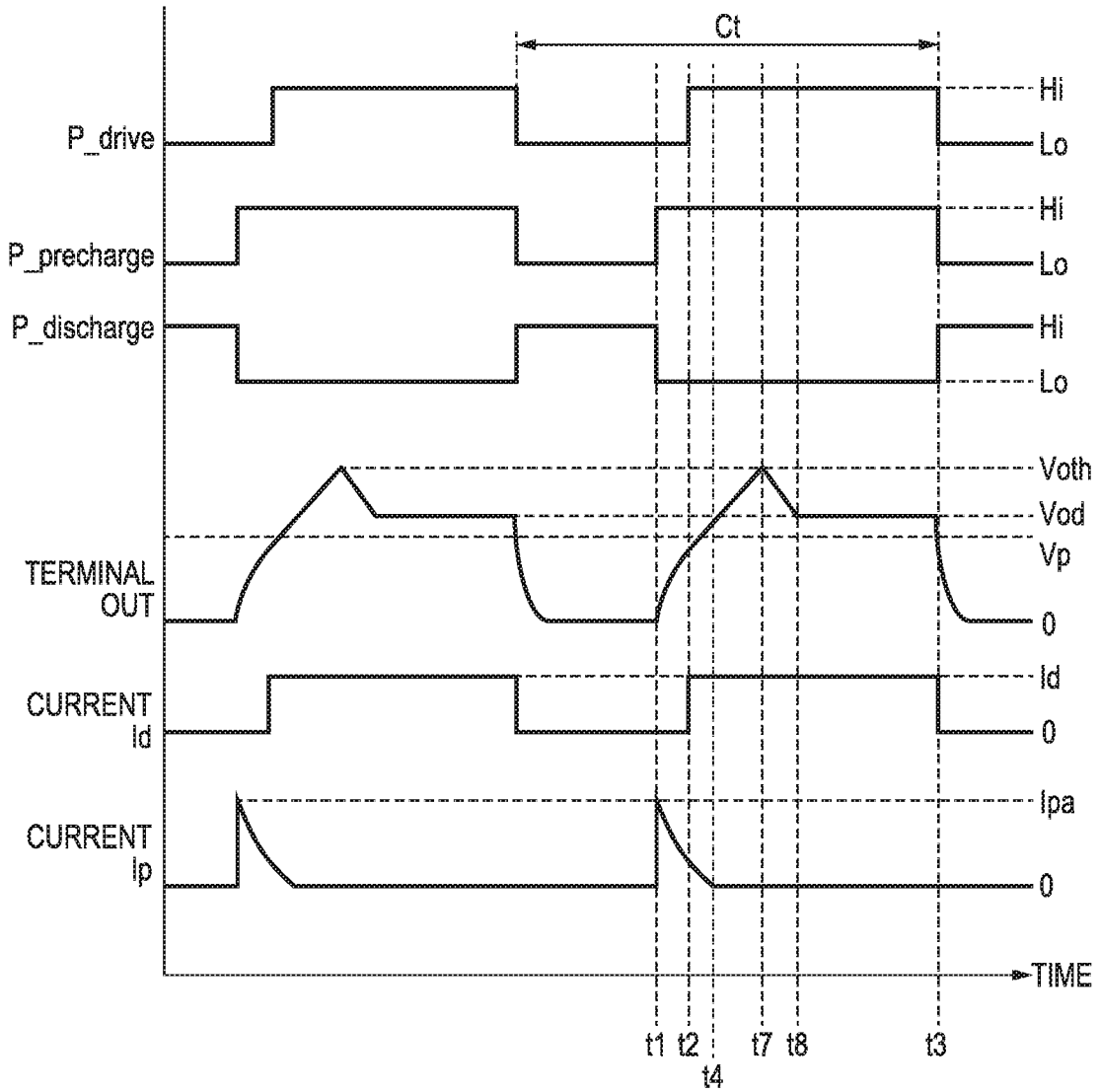
FIG. 9 is a timing chart showing an example of the driving timing of the driving apparatus in FIG. 1.

Described next is how the operation of the driving apparatus 100 according to this embodiment is effective in speeding up driving control. When a sufficient pre-charge period with the application of a voltage from the voltage supply circuit 1102 cannot be ensured, the arrangement disclosed in Japanese Patent Laid-Open No. 2008-58398 cannot charge a parasitic capacitance to the voltage Vp within the pre-charge period, and turns off the application of a voltage in the middle of charging. When the application of a voltage from the voltage supply circuit 1102 is turned off in the middle of charging, the light emission start timing tends to vary depending on the magnitude of the amount of current Id supplied from the current output circuit. As a result, the controllability based on the driving apparatus 100 deteriorates. It is when speeding up is required that the anode terminals of 100 light-emitting thyristors are connected to one output terminal OUT, for example, as in the case of the light-emitting thyristors L shown in FIG. 4. In order to obtain an image corresponding to one row, it is necessary to repeat light emission control 100 times. Accordingly, it is important to shorten the light emission time per cycle. The effects of this embodiment will be described with reference to the timing chart of FIG. 9. The symbols and outlines of operations at the respective timings in FIG. 9 are the same as those in FIG. 7. The following description will be made on the assumption that the voltage Vp applied by the voltage supply circuit 1102 is equal to or less than the light emission threshold voltage Voth of the light-emitting thyristor and equal to or less than the built-in potential Vod.

First of all, at time t1, the signal P_precharge is set at Hi, and the signal P_discharge is set at Lo. The current Ip flows from time t1 by the application of a voltage by the voltage supply circuit 1102. At the same time when the potential of the output terminal OUT rises, the current Ip gradually decreases from time t1 to time t2. At time t2, the current output circuit 1101 starts supplying the current Id (timing T1). At time t2, because the potential of the output terminal OUT has not reached the voltage Vp, the supply of the current Ip by the application of a voltage from the voltage supply circuit 1102 is continued. At time t4, when the potential of the output terminal OUT reaches the voltage Vp, the voltage supply circuit 1102 stops supplying the current Ip. After the supply of the current Ip is stopped, the current Id supplied by the current output circuit 1101 raises the voltage of the output terminal OUT to the light emission threshold voltage Voth of the light-emitting thyristor L. At time t7, after the voltage of the output terminal OUT reaches the light emission threshold voltage Voth, the voltage gradually drops toward the built-in potential Vod. At time t8, although the voltage of the output terminal OUT reaches the built-in potential Vod, the light emission start timing of the light-emitting thyristor L comes after time t7, and actual light emission starts near time t8.

In this embodiment, in order to speed up driving control, the time from time t1 to time t2 is set to be short. Accordingly, at time t2 when the current output circuit 1101 starts supplying the current Id, the voltage of the output terminal OUT has not reached the voltage Vp. However, after time t2, the voltage supply circuit 1102 keeps supplying the current Ip by applying a voltage until the voltage of the output terminal OUT reaches the voltage Vp. This reduces variations in the time until the voltage of the output terminal OUT reaches the voltage Vp as compared with a case in which such variations depend on only the current Id supplied from the current output circuit 1101, which changes in accordance with the luminance of emitted light. In addition, setting the voltage Vp applied by the voltage supply circuit 1102 to a voltage near the light emission threshold voltage Voth can reduce variations in the time until the start of light emission and hence can implement high-accuracy light emission control. Making the timing at which the current output circuit 1101 starts supplying the current Id differ from the timing at which the voltage supply circuit 1102 turns off the application of a voltage makes it possible to control switching noise as compared with a case in which the timings simultaneously make transition. In addition, supplying the current Id supplied from the current output circuit 1101 and the current Ip accompanying the application of a voltage from the voltage supply circuit 1102 makes it possible to perform high-accuracy driving control at high speed.

In this embodiment, switching noise can be effectively suppressed by driving the light-emitting thyristor L using the driving apparatus 100. This makes it possible to stabilize the voltage value of a pre-charge voltage and the current output circuit 1101 and suppress light amount deviation and light emission start timing variations, thereby implementing high-accuracy light emission control. Although the light-emitting thyristor L has been exemplified as a load element, it is possible to implement fast, high-accuracy light emission control even for other types of light-emitting elements by using the above operation of the driving apparatus 100. In addition, the controllability of driving improves even for load elements other than light-emitting elements.

Figure 10:
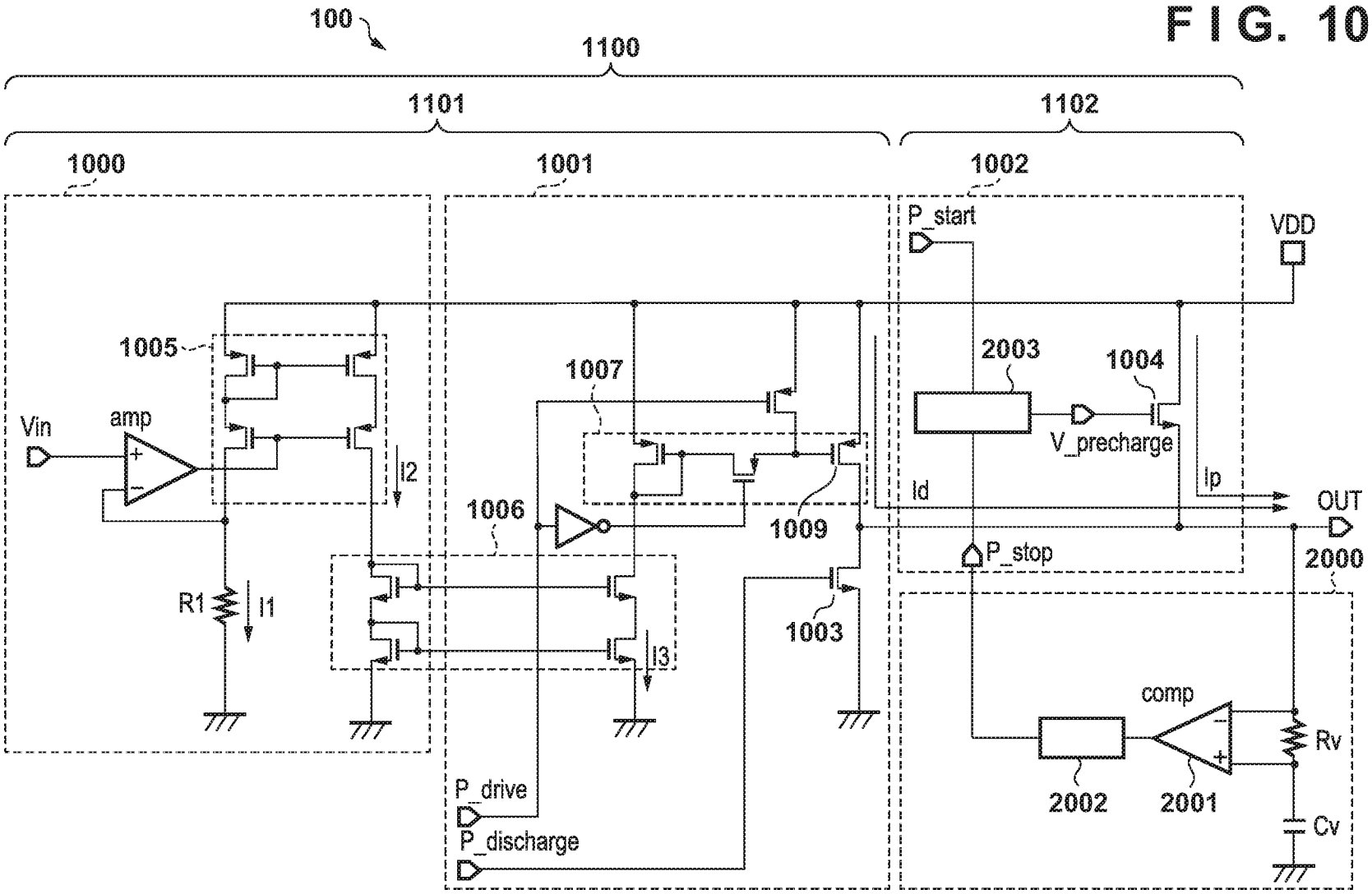
FIG. 10 is a circuit diagram showing a modification of the arrangement of the driving apparatus in FIG. 1.
Figure 11:
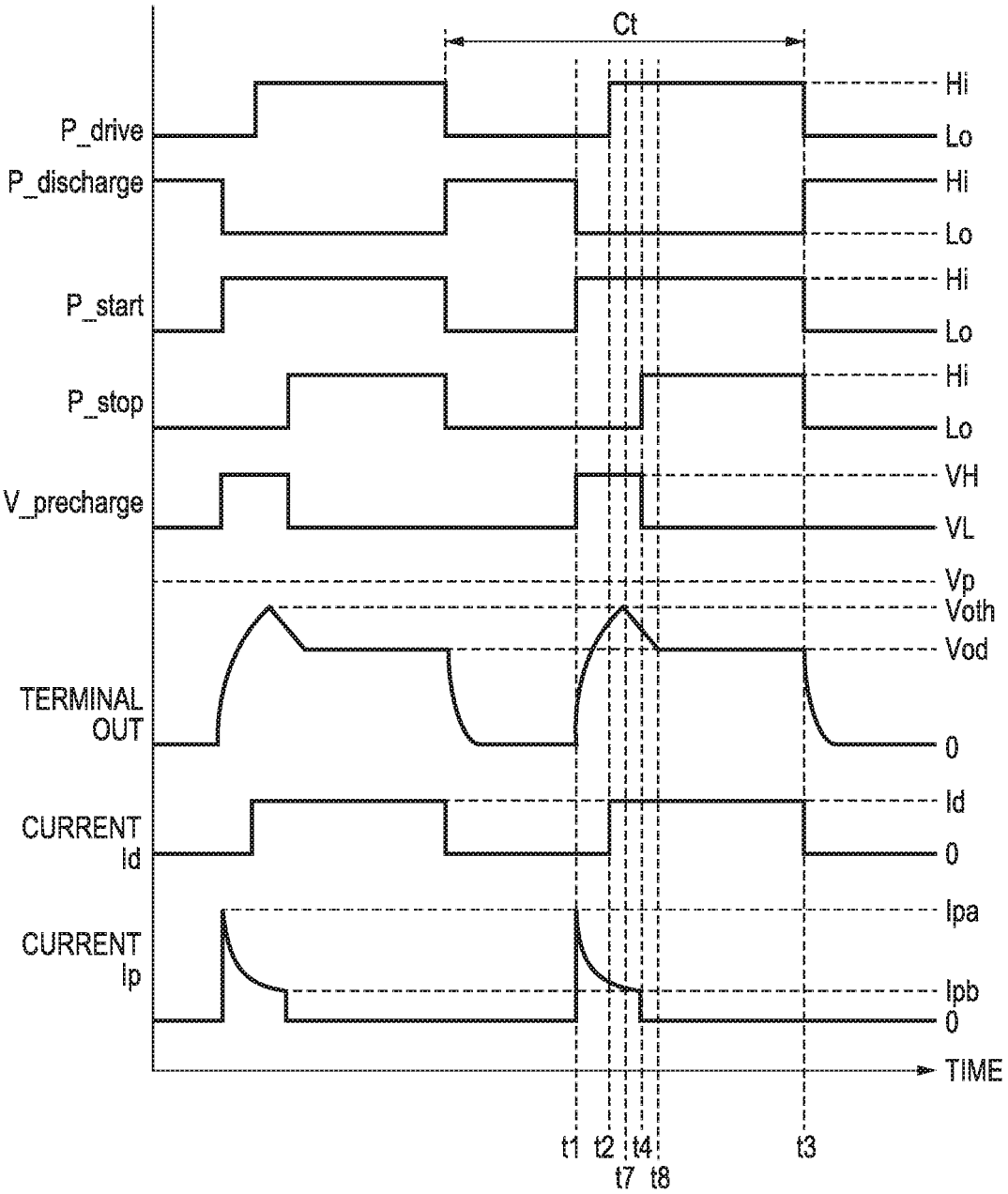
FIG. 11 is a timing chart showing an example of the driving timing of the driving apparatus in FIG. 10.

The structure and operation of a driving apparatus according to a second embodiment will be described with reference to FIGS. 10 and 11. FIG. 10 is a circuit diagram showing an example of the arrangement of a driving circuit 1100 of a driving apparatus 100 according to this embodiment. FIG. 11 is a timing chart for explaining the operation timing of the driving circuit 1100 of the driving apparatus 100 according to the embodiment. As compared with the first embodiment, a voltage Vp applied by a voltage supply circuit 1102 is set to be higher than a light emission threshold voltage Voth. In addition, the voltage of an output terminal OUT exceeds the light emission threshold voltage Voth, and the application of a voltage by the voltage supply circuit 1102 is turned off at the subsequent timing at which the voltage drops. The driving circuit 1100 has an arrangement for detecting the voltage of the output terminal OUT. Other arrangements may be similar to those of the first embodiment described above, and hence different portions will be mainly described. However, a description of a portion that may be similar to that in the first embodiment will be appropriately omitted. This embodiment can further speed up control as compared with the first embodiment.

Referring to FIG. 10, the driving circuit 1100 is provided with a voltage detection unit 2000 for detecting the voltage of the output terminal OUT. A pre-charge control unit 1002 of the voltage supply circuit 1102 receives a signal P_start that informs the timing at which the voltage supply circuit 1102 is turned on and a signal P_stop that informs the timing at which the voltage supply circuit 1102 is turned off. The pre-charge control unit 1002 is also provided with a control unit 2003 that generates a voltage V_precharge in accordance with the signal P_start and the signal P_stop and drives a switch 1004. The signal P_charge according to the first embodiment corresponds to the voltage V_precharge. The switch 1004 is ON/OFF-driven in a similar manner to that in the first embodiment described above. However, the voltage V_precharge is renamed because it indicates a voltage input to the gate of the switch 1004 instead of Hi/Lo of the signal P_discharge.

In this embodiment, assume that a power supply VDD is 5 V, the light emission threshold voltage Voth of a light-emitting element as a load element is 2.0 V, and a built-in potential Vod is 1.5 V. The voltage Vp applied by the voltage supply circuit 1102 is set to 2.5 V so as to exceed the light emission threshold voltage Voth. For example, the power supply VDD may be used as the voltage Vp. As the voltage Vp applied from the voltage supply circuit 1102 increases, the parasitic capacitance of a light-emitting element as a load element can be charged faster, and the start of light emission by the light-emitting element can be quickened. Although the switch 1004 is exemplified as having an arrangement using an NMOS transistor as in the first embodiment, this is not exhaustive. For example, in order to use the voltage Vp applied by the voltage supply circuit 1102 as the power supply VDD, the power supply VDD is supplied to the drain terminal of the switch 1004, and a general open/short switch is used as the switch 1004. When the voltage Vp is to be applied from the voltage supply circuit 1102, short-circuiting the switch 1004 makes it possible to apply the voltage value of the power supply VDD to the output terminal OUT.

Even if the applied voltage Vp is raised, driving control can be performed accurately and fast by turning off the application of a voltage by the voltage supply circuit 1102 by the time when the light-emitting element starts emitting light (timing T2). When a load element is the light-emitting thyristor L shown in FIG. 4, a voltage drop occurs before the start of light emission after the voltage of the anode terminal of the light-emitting thyristor L exceeds the light emission threshold voltage Voth. During this voltage drop, light emission control can be performed accurately and fast by turning off the application of a voltage by the voltage supply circuit 1102.

In contrast, if the voltage Vp applied from the voltage supply circuit 1102 is excessively raised with respect to the light emission threshold voltage Voth, it becomes difficult to detect a voltage drop at the output terminal OUT which appears when a light-emitting thyristor L is driven. For this reason, when timing T2 at which the application of a voltage by the voltage supply circuit 1102 is turned off is determined by detecting a voltage drop at the output terminal OUT, it is difficult to perform high-accuracy driving control. When a plurality of light-emitting thyristors L are connected to the output terminal OUT of the driving circuit 1100, the voltage Vp may be designed to be slightly higher than the maximum value of the light emission threshold voltage Voth of the plurality of light-emitting thyristors L.

Driving timings in this embodiment will be described with reference to FIG. 11. At time t1, the signal P_start is set at Hi, and the signal P_discharge is set at Lo. As the signal P_start is set at Hi, the control unit 2003 sets the voltage V_precharge to a voltage VH, and turns on the application of a voltage by the voltage supply circuit 1102 from time t1. With this operation, a peak current Ipa from the voltage supply circuit 1102 flows in the output terminal OUT. At the same time when the voltage of the output terminal OUT rises from time t1 toward time t2, a current Ip gradually decreases. The current output circuit 1101 then starts supplying a current Id at time t2 (timing T1). At this time, because the voltage of the output terminal OUT does not reach 2.5 V, the supply of the current Ip by the application of a voltage by the voltage supply circuit 1102 continues.

At time t7, the voltage of the output terminal OUT reaches 2 V, which is the light emission threshold voltage Voth of the light-emitting thyristor L. At time t7, because the light-emitting thyristor L starts driving and a current flows, the voltage of the output terminal OUT starts dropping. The period from time t7 to time t8 is a period in which the voltage of the output terminal OUT is dropping. At time t4 during a period in which the voltage is dropping, the control unit 2003 sets the voltage V_precharge to a voltage VL, and turns off the application of a voltage by the voltage supply circuit 1102 (timing T2). With this operation, the supply of the current Ip from the voltage supply circuit decreases from an immediately preceding current Ipb to zero.

The first embodiment described above has exemplified the case in which the voltage supply circuit 1102 is kept ON after time t4. In this embodiment, it is necessary to turn off the application of a voltage by the voltage supply circuit 1102. This is because, if the application of a voltage is not turned off, the voltage Vp is higher than the light emission threshold voltage Voth, and hence the voltage supply circuit 1102 keeps supplying the current Ip, resulting in a failure to implement high-accuracy driving control in which the amount of light can be determined by only the driving current Id of the constant current circuit. In order to implement high-speed driving control while maintaining high accuracy, the current output circuit 1101 starts supplying the current Id, and the application of a voltage from the voltage supply circuit 1102 is turned off in accordance with a voltage drop after the voltage of the output terminal OUT reaches the light emission threshold voltage Voth. Immediately after a volte drop, because there is a delay in light emission by the light-emitting thyristor L, the light-emitting thyristor L has not started emitting light, and high-accuracy driving control can be maintained.

With regard to the timing of a voltage drop, timing T2 can be finely adjusted for each element in accordance with externally input pulses upon individually checking the respective element characteristics such as the light emission threshold voltage of each light-emitting thyristor L to be driven and variations in parasitic capacitance. However, this operation is very cumbersome. Accordingly, this embodiment is provided with the voltage detection unit 2000 that monitors the voltage of the output terminal OUT and outputs a signal for turning off the application of a voltage by the voltage supply circuit 1102 in accordance with a voltage drop at the output terminal OUT after the current output circuit 1101 starts supplying a current.

A method of detecting (monitoring) a voltage drop at the output terminal OUT can use a known technique. For example, the voltage detection unit 2000 shown in FIG. 10 is an example of a circuit that monitors a voltage drop at the node of the output terminal OUT. A capacitor Cv of the voltage detection unit 2000 is connected to the node of the output terminal OUT to be monitored via a resistor Rv. A comparator 2001 compares the voltages at both ends of the resistor Rv. When the potential on the output terminal OUT side becomes lower, the comparator 2001 outputs a signal. A latch circuit unit 2002 latches the output signal output from the comparator 2001, and transfers the occurrence of a voltage drop as the signal P_stop to the control unit 2003 of the pre-charge control unit 1002 of the voltage supply circuit 1102 by, for example, inverting the output signal after latching.

The driving timing in FIG. 11 indicates that the application of a voltage by the voltage supply circuit 1102 is turned off at the timing when the signal P_stop is set at Hi (timing T2). The control unit 2003 processes the signal P_start that informs the timing at which the application of a voltage by the voltage supply circuit 1102 is turned on and a signal P_end that informs the timing at which the application of a voltage by the voltage supply circuit 1102 is turned off. This determines the period in which the voltage supply circuit 1102 applies a voltage, and ON/OFF-controls a switch 1004. When the voltage V_precharge takes the voltage VH, the control unit 2003 gives the switch 1004 with a voltage value serving to turn on the voltage supply circuit 1102 to apply the voltage Vp to the load element. When the voltage V_precharge takes the voltage VL, the control unit 2003 gives the switch 1004 with a voltage value serving to turn off the voltage supply circuit 1102 to apply no voltage to the load element. In the case shown in FIG. 10, the control unit 2003 is provided with the control unit 1008 in FIG. 1 according to the first embodiment. In this arrangement, the voltage Vcharge may be applied to the control unit 1008 to generate the voltage VH, and the voltage VL may be set at the ground potential. The output terminal OUT to be monitored is included in the driving circuit 1100 of the driving apparatus 100. Accordingly, incorporating a circuit (voltage detection unit 2000) capable of detecting the voltage of the output terminal OUT in the driving apparatus 100 can speed up response and hence facilitates implementing high-accuracy driving control.

In this embodiment, the above operation of the driving apparatus 100 can improve controllability with respect to the load element as in the first embodiment. In addition, the driving described in the embodiment can further speed up driving control.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-159727, filed Sep. 2, 2019 which is hereby incorporated by reference herein in its entirety.

What is claimed is:

1. A driving apparatus for driving a load element, the apparatus comprising a driving circuit including: an output terminal to which the load element is connected; a current output circuit configured to supply a current to the load element via the output terminal; a voltage supply circuit configured to apply a voltage to the load element via the output terminal; a first signal line configured to control a timing at which the current output circuit starts supplying a current to the load element; and a second signal line configured to control a timing at which the voltage supply circuit is turned off, wherein the voltage supply circuit starts applying a voltage before the current output circuit supplies a current to the load element, and a timing at which the current output circuit starts supplying a current differs from a timing at which the voltage supply circuit turns off application of a voltage.

2. The apparatus according to claim 1, wherein the voltage supply circuit turns off application of a voltage after a lapse of a predetermined period since the current output circuit starts supplying a current.

3. The apparatus according to claim 1, wherein a timing at which the current output circuit ends supplying a current coincides with a timing at which the voltage supply circuit turns off application of a voltage.

4. The apparatus according to claim 1, wherein the voltage supply circuit turns off application of a voltage before the current output circuit starts supplying a current.

5. The apparatus according to claim 1, wherein the voltage supply circuit turns off application of a voltage after the current output circuit starts supplying a current and before the current output circuit ends supplying a current.

6. The apparatus according to claim 1, wherein the voltage supply circuit turns off application of a voltage in accordance with a voltage drop at the output terminal after the current output circuit starts supplying a current.

7. The apparatus according to claim 6, wherein the driving circuit further includes a voltage detection unit configured to monitor a voltage of the output terminal and turn off application of a voltage by the voltage supply circuit in accordance with a voltage drop at the output terminal after the current output circuit starts supplying a current.

8. The apparatus according to claim 6, wherein a voltage that the voltage supply circuit applies to the load element is higher than a threshold voltage under which the load element operates.

9. The apparatus according to claim 6, wherein a voltage that the voltage supply circuit applies to the load element is higher than a threshold voltage under which the load element operates, and the voltage supply circuit is turned off after the current output circuit starts supplying a current and before the current output circuit ends supplying a current.

10. The apparatus according to claim 1, wherein a voltage that the voltage supply circuit applies to the load element is not more than a threshold voltage under which the load element operates.

11. The apparatus according to claim 1, wherein the voltage supply circuit applies, to the load element, a voltage from a voltage source of a voltage higher than a threshold voltage under which the load element operates.

12. The apparatus according to claim 1, wherein the voltage supply circuit includes a voltage supply transistor configured to control application of a voltage to the load element and OFF of application of a voltage.

13. The apparatus according to claim 12, further comprising a control circuit configured to control a gate voltage of the voltage supply transistor.

14. The apparatus according to claim 12, wherein the current output circuit includes a current output transistor configured to control ON or OFF of supply of a current to the load element, and the voltage supply transistor differs in conductivity type from the current output transistor.

15. The apparatus according to claim 1, wherein a plurality of the load elements are connected to the output terminal.

16. The apparatus according to claim 1, further comprising a plurality of the driving circuits.

17. The apparatus according to claim 1, further comprising a reset circuit configured to reset a potential of the output terminal.

18. The apparatus according to claim 17, wherein a timing at which the current output circuit ends supplying a current coincides with a timing at which the reset circuit starts resetting a potential of the output terminal.

19. The apparatus according to claim 1, wherein the load element comprises a current-driven element.

20. The apparatus according to claim 1, wherein the load element comprises a light-emitting element.

21. The apparatus according to claim 20, wherein the light-emitting element comprises a light-emitting thyristor.

22. A printing apparatus comprising:

an exposure head including a driving apparatus according to claim 1;

a light-emitting element mounted as the load element on the exposure head; and a photosensitive drum configured to receive light from the light-emitting element.

* * * * *